US008935814B1

(12) United States Patent
Tu

(10) Patent No.: US 8,935,814 B1
(45) Date of Patent: Jan. 20, 2015

(54) METHOD AND APPARATUS FOR AN AUTOMATIC PATIENT LIFT

(71) Applicant: Ton Duc Thang University, Ho Chi Minh (VN)

(72) Inventor: Cong Thanh Diep Tu, Ho Chi Minh (VN)

(73) Assignee: Ton Duc Thang University, Ho Chi Minh (VN)

( * ) Notice: Subject to any disclaimer, the term of this patent is extended or adjusted under 35 U.S.C. 154(b) by 0 days.

(21) Appl. No.: 14/229,829

(22) Filed: Mar. 28, 2014

Related U.S. Application Data

(63) Continuation of application No. 14/164,146, filed on Jan. 25, 2014, now abandoned.

(51) Int. Cl.
*A61G 7/10* (2006.01)

(52) U.S. Cl.
CPC ..... *A61G 7/10* (2013.01); *A61G 7/1017* (2013.01); *A61G 7/1015* (2013.01); *A61G 7/1051* (2013.01); *A61G 7/1059* (2013.01); *Y10S 414/134* (2013.01)
USPC ..... 5/81.1 R; 5/83.1; 5/86.1; 5/87.1; 5/89.1; 414/921

(58) Field of Classification Search
CPC ..... A61G 7/10; A61G 7/1015; A61G 7/1017; A61G 7/1019; A61G 7/1046; A61G 7/1048; A61G 7/1049; A61G 7/1051; A61G 7/1057; A61G 7/1059; A61G 7/1061; A61G 7/1076; A61G 7/16; A61G 2007/16; A61G 2007/165
USPC ..... 5/81.1 R, 83.1, 87.1, 88.1, 86.1, 89.1; 414/921; 212/901
See application file for complete search history.

(56) References Cited

U.S. PATENT DOCUMENTS

| | | | | |
|---|---|---|---|---|
| 2,683,882 | A * | 7/1954 | Smith | 5/86.1 |
| 3,931,956 | A * | 1/1976 | Hawkins | 254/8 B |
| 5,201,377 | A * | 4/1993 | Wilson | 180/6.5 |
| 7,040,641 | B2 * | 5/2006 | Wing | 280/304 |
| 7,657,951 | B2 * | 2/2010 | Tally | 5/86.1 |
| 7,694,360 | B2 * | 4/2010 | Tally | 5/86.1 |
| 8,272,084 | B2 * | 9/2012 | Spidare et al. | 5/83.1 |
| 8,316,480 | B2 * | 11/2012 | Burak et al. | 5/87.1 |
| 8,650,676 | B2 * | 2/2014 | Lin | 5/87.1 |
| 2006/0080775 | A1 * | 4/2006 | McWattie et al. | 5/89.1 |
| 2010/0229299 | A1 * | 9/2010 | Lear | 5/89.1 |

* cited by examiner

*Primary Examiner* — Nicholas Polito

(57) ABSTRACT

A method and apparatus for lifting a patient is disclosed to include a base with wheels on the back side and casters on the front side; a pair of extendable legs extended or withdrawn from the frontal side of the base to maintain balance when lifting a patient; vertical masts connected to a three-prong hanger; three durable cables used with a sling assembly to lift the patient; a foldable chair provides temporary rest for the patient on the patient lift; and a control panel having a micro-controller for remotely controlling the patient lift.

13 Claims, 5 Drawing Sheets

METHOD AND APPARATUS FOR AN AUTOMATIC PATIENT LIFT

CLAIM OF PRIORITY

This application is a continuation of application Ser. No. 14/164,146, filed Jan. 25, 2014, entitled, "Method and Apparatus for a Flexible Patient Lift". The patent application identified above is incorporated here by reference in its entirety to provide continuity of disclosure.

FIELD OF THE INVENTION

The present invention relates generally to the field of medical devices. More specifically, the present invention relates to transporting and lifting a patient.

BACKGROUND ART

Whether at home or in a hospital, patients or elderly are often in need to be transported safely from one place to another place. It is dangerous for post-surgery patients to move by themselves. In other situations, the elderly need assistance to transfer from bed to chair in a different room or to a toilet.

Traditionally, conventional patient lifts do not include enough function to adapt to different situations when a patient needs to be transported. Due to their feeble health conditions, mismanaging a particular situation can be dangerous or often found fatal to the patients or the elderly. Particular situations may include transporting a patient from a recumbent position to a seated position at a different location. The destination can be far away or can be to a next bed. Another situation occurs when the patient is transported changing from a seated position to a recumbent position. Yet another situation occurs when transporting a patient to a toilet. Conventional patient lift devices cannot provide sufficient functions to assist medical users to help patients to sit in a correct direction.

Yet another problem of the conventional patient lifts is that they are not equipped with appropriate motors designed to perform a specific task. Conventional patient lifts do have motors but these motors are not designed to operate in a specific situation to eliminate physical damages to the patients.

Yet another problem of the conventional patient lifts is that their sing assemblies are not flexible to change patient posture from recumbent to seated position or vice verse. Conventional patient lifts still need a nurse or medical assistant to erect a patient when changing from recumbent to seated position. This can create a lot of stresses to the patient.

And yet another problem with conventional patient lifts is that the conventional patient lift does not include a temporary support chair for a patient to rest when transport in a long distance. This is true for the elderly. They can sit and rest on the chair but it is physically taxing to their health when they are transported on conventional sling assembly.

Therefore what is needed is a patient lift that can overcome the above described problems.

SUMMARY OF THE INVENTION

Accordingly, an objective of the present invention is to provide a patient lift that meets the needs of patients. Thus, a method and apparatus for lifting a patient is disclosed to include a base with wheels on the back side and casters on the front side; a pair of extendable legs extended or withdrawn from the frontal side of the base to maintain balance when lifting a patient; vertical masts connected to a three-prong hanger; three durable cables used with a sling assembly to lift the patient; a foldable chair provides temporary rest for the patient on the patient lift; and a control panel having a micro-controller for remotely controlling the patient lift.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
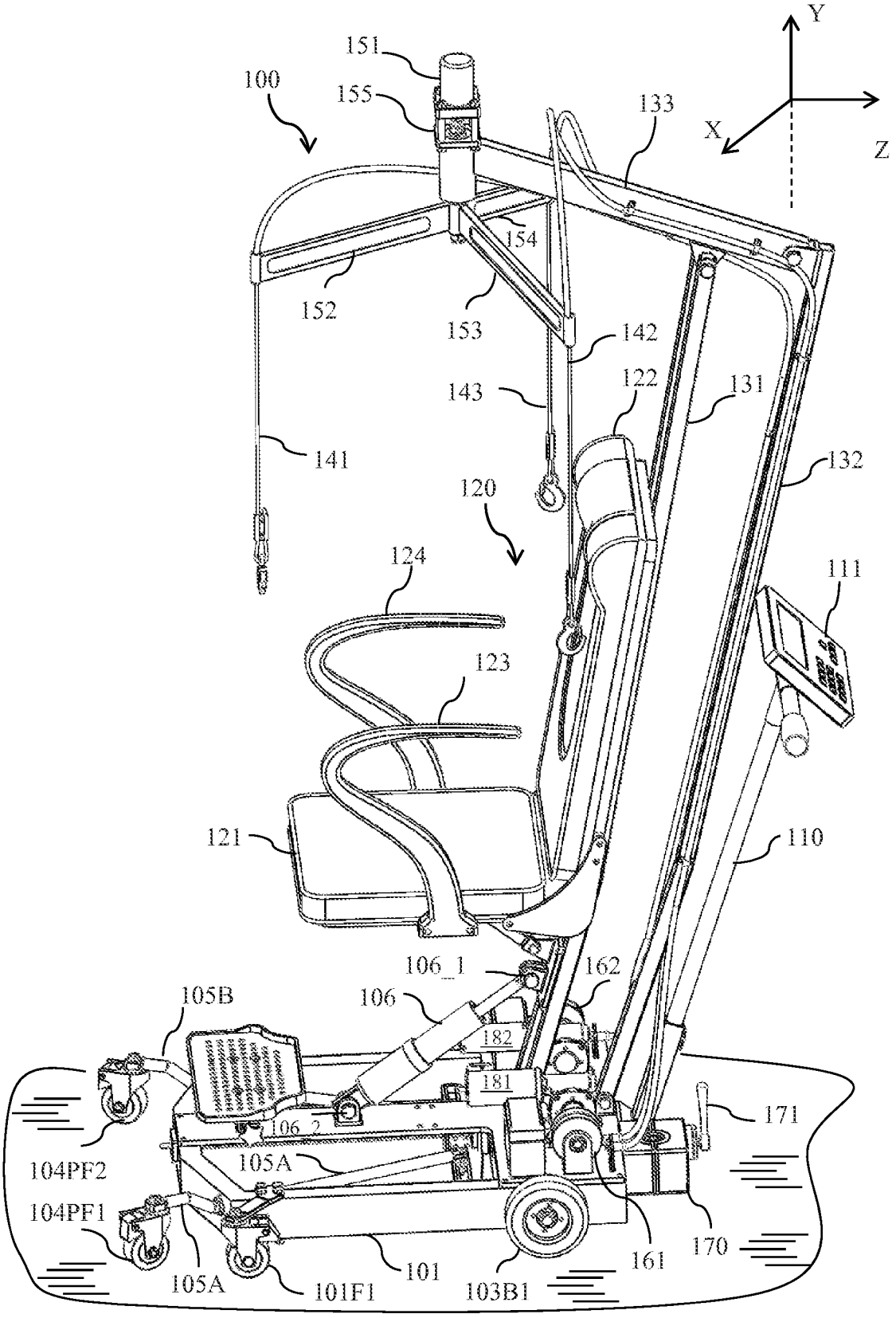
FIG. 1 is a diagram illustrating a patient lift in accordance with an embodiment of the present invention.

One embodiment of the invention is now described with reference to FIGS. 1 to 3. FIG. 1 shows one embodiment of a patient lift 100. The patient lift 100 includes a base 101 having a front side and a back side. The base 101 is mounted on a first wheel 101F1, a second wheel 101F2 (not seen in FIG. 1; please refer to FIG. 3), a third wheel 103B1, and a fourth wheel 103B2 (not seen in FIG. 1; see FIG. 3). In one embodiment, third wheel 103B1 is mechanically connected to the backside of base 101 and electrically connected to a first motor 311 (not shown in FIG. 1; please see FIG. 3) whereas fourth wheel 103B2 is connected to a second motor 312. In the embodiment shown in FIG. 1, first wheel 101F1 and second wheel 101F2 are caster wheels. That is, they are configured to swivel and change directions as base 101 is moving.

Continuing with FIG. 1, a first extendable leg 105A and a second extendable leg 105B are mechanically connected to base 101. First extendable leg 105A and said second extendable leg 105B configured to extend or withdraw from the front side of base 101. A third motor 313 (not shown in FIG. 1 but can be seen in FIG. 3) is mechanically connected to first extendable leg 105A and second extendable leg 105B via a glider 315 and a spring 316 (please see FIG. 3) in order to cause first extendable leg 105A and second extendable leg 105B extend outward or withdraw from the front side of base 101 through openings as shown in FIG. 1. In addition, a fifth wheel 104PF1 is mechanically connected to first extendable leg 105A and a sixth wheel 104PF2 is mechanically connected to second extendable leg 105B respectively. In one embodiment, fifth wheel 104PF1 and sixth wheel 104PF2 are caster wheels similar to first wheel 101F1 and second wheel 101F2.

Referring again to FIG. 1, a first mast 131 and a second mast 132 are mechanically connected to the back side of base 101. In one embodiment, the lengths of first mast 131 and second mast 131 are designed to be adjusted so that patient lift 100 can be folded. On top of first mast 131 and second 132 mast, lever 133 is extended forward toward the front side of base 101. There, a three-prong hanger having a first prong 152, a second prong 153, and a third prong 154 mechanically connected to lever 133. A rotator 155 interconnects to lever 133 and three-prong hanger 152-154 so that three-prong hanger 162-164 can rotate freely in clockwise and counter-clockwise around a vertical axis. Rotator 155 is designed so that a medical assistant can help the patient to face in a correct direction, especially when the patient needs to sit down a chair or a toilet bowl. A fourth motor 151 is connected to rotator 155 and operable to cause rotator 155 to rotate.

Continuing with FIG. 1, a first cable 141, a second cable 142, and a third cable 143 are connected to each prong of said three-prong hanger 152-154 respectively. In one embodiment, first cable 141, second cable 142 configured to operate simultaneously and third cable 143 are configured to extend or withdraw independently of first cable 141 and second cable 142. A sling assembly 201 (not shown in FIG. 1, please refer to FIG. 2) having three different holes are used to first cable 141, second cable 142, and third cable 143. In one embodiment, said third cable 143 is connected to sling assembly 201 at a location between the patient's two legs, to first cable 141 at the patient's left shoulder, and to second cable 142 at the patient's right shoulder.

Next, a foldable chair 120 is mechanically connected to first mast 131 and second mast 133. In one embodiment, foldable chair 120 has a support portion 121 configured to support a patient, and a back portion 122. A left hand rest 123 and a right hand rest 124 are connected to support portion 121.

Continuing again with FIG. 1, a removable fifth motor 106 is mechanically connected between first mast 131 and base 101. In one embodiment, one end of removable fifth motor 106 is fixedly connected to first mast 131 and said support portion 121 of foldable chair 120. The distal end of removable fifth motor 106 can be removed so that patient lift 100 can be folded up.

Next, a first pulley 811 is mechanically coupled to first cable 141 and second cable 142. A sixth motor is mechanically connected to first pulley 161. Sixth motor 181 is designed to control first cable 141 and second cable 142 simultaneously. On the other hand, second pulley 162 houses to third cable 143. A seventh motor 182 is mechanically connected to second pulley 162, operable to control said third cable 143.

Still referring to FIG. 1, a handle 110 connected to the rear and of base 101. On top of handle 110, a control panel 111 is designed to control the operations of first motor 311 second motor 312, third motor 313, fourth motor 151, fifth motor 106, sixth motor 181, and seventh motor 182.

Finally, a switch box 170 is coupled to second wheel 103B1 and fourth wheel 103B2. Switch box 170 is configured to decouple third wheel 103B1 and fourth wheel 103B2 from first motor 311 and second motor 312 so that patient lift 100 can be pushed by the medical assistant.

In one embodiment, base 101 has a width of 0.75 meters, a maximum length when first extendable leg 105A and second extendable leg 105B are fully extended is 1.6 meters. Base 101 has a minimum length of 1.2 meters when first extendable leg 105A and second extendable leg 105B are fully withdrawn. The height of base 101 including first mast 131 and second mast 132 is 2.25 meters calculated for average human heights between 1.7 meters to 1.9 meters.

The following table lists all the motors described above:

| Motor | Power | Speed |
|---|---|---|
| First motor 311 and Second Motor 312 | 106.57 W | 200 rounds/minutes |
| Third motor 313 | 30 W | 300 rounds/minutes |
| Fourth motor 151 | 30 w | 12 rounds/minutes |
| Fifth motor 106 | 400 W | N/A |
| Sixth motor 181 | 186.5 W | 21 rounds/minute |
| Seventh motor 182 | 93.25 W | 20 rounds/minute |

Figure 2:
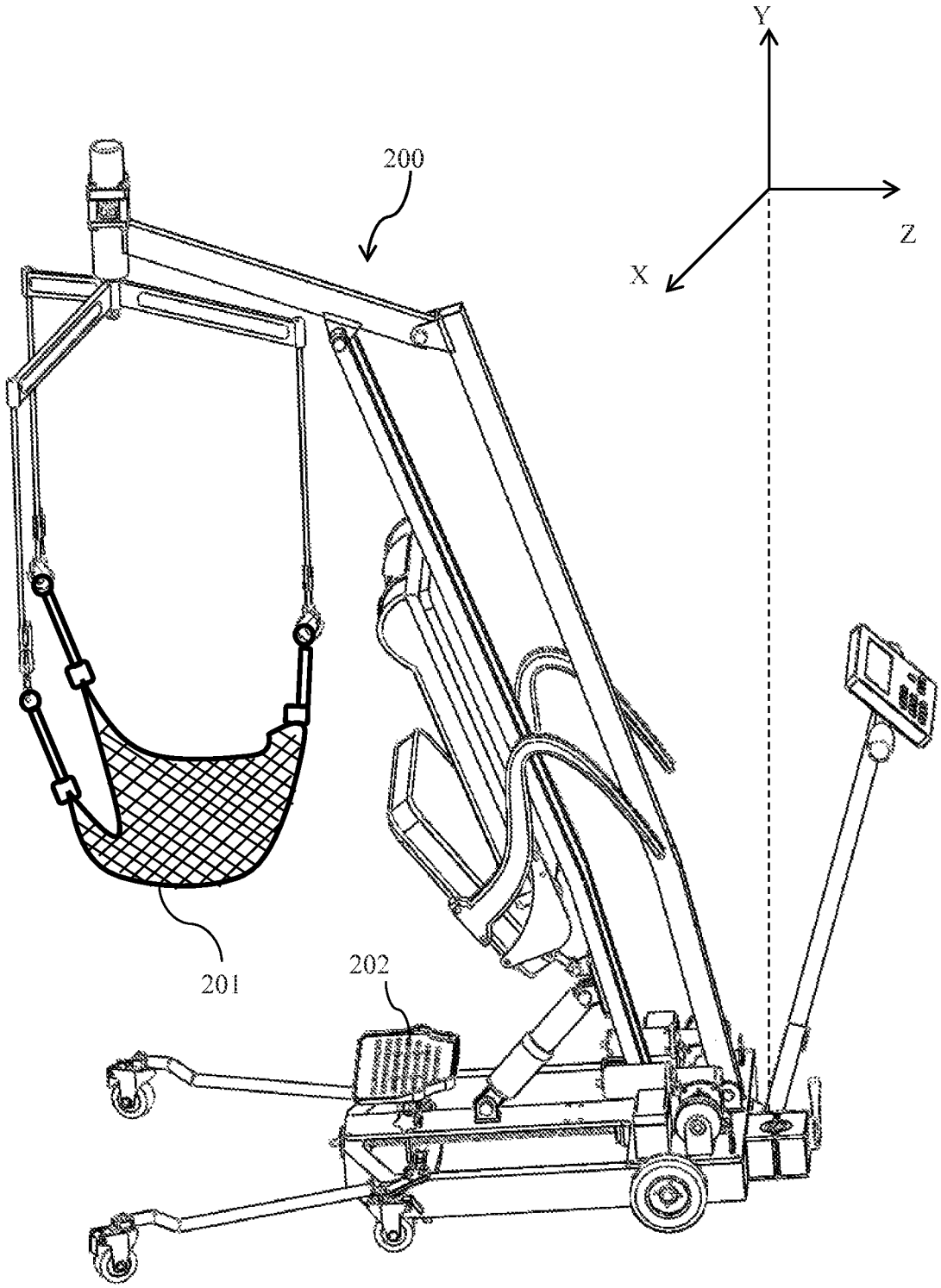
FIG. 2 is a diagram illustrating a patient lift when it is in the lean forward state to receive a patient in accordance with an embodiment of the present invention.

Now referring to FIG. 2, patient lift 100 is controlled by control panel 111 to lean forward to pick up a patient. The detailed operation of control panel 111 and patient lift 100 will be discussed later. FIG. 2 also illustrates mast assembly 201 on which a patient is lifted and transported to either foldable chair 120 or to a nearby location.

Figure 3:
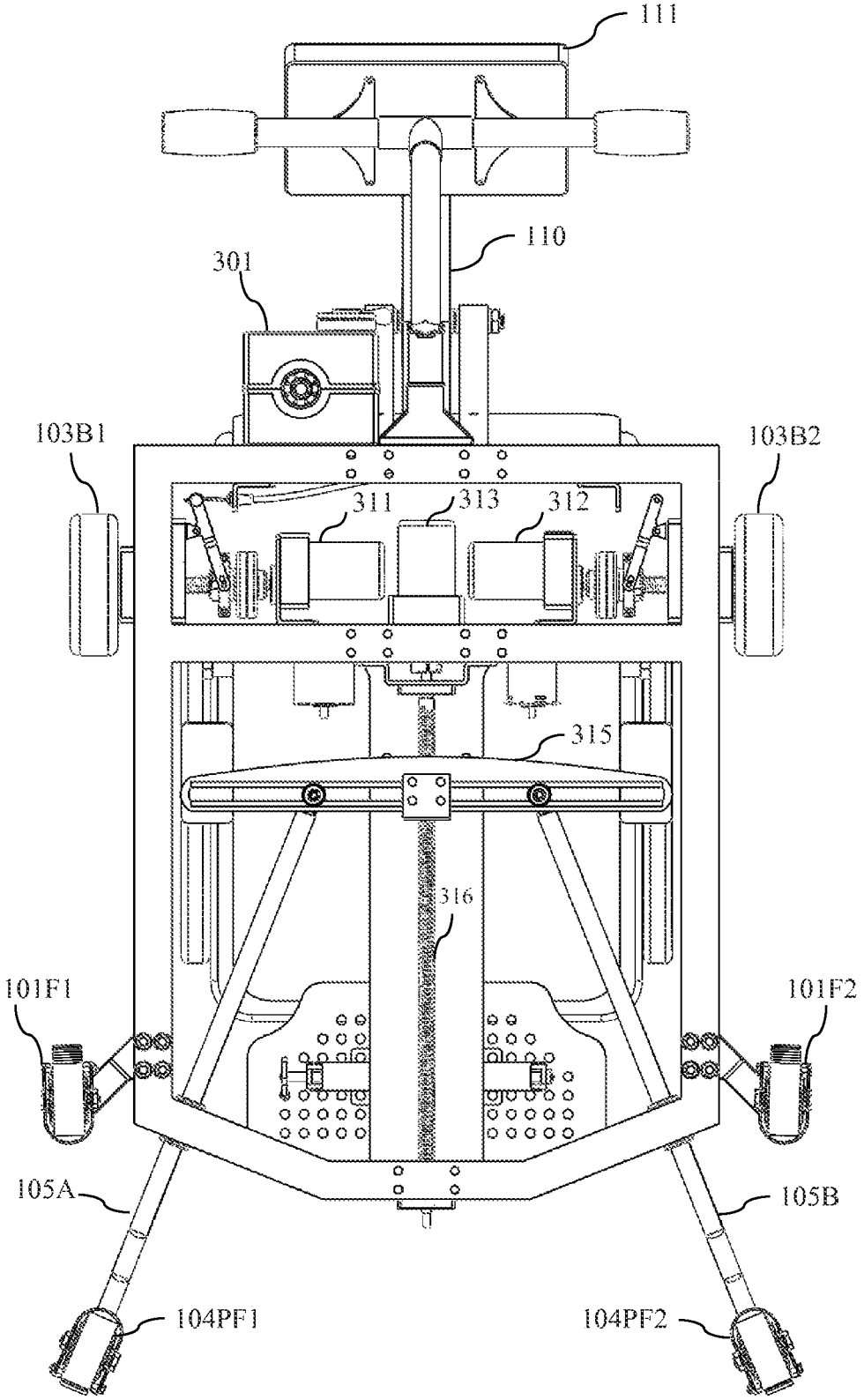
FIG. 3 is a diagram illustrating the components inside the base of the patient lift in accordance with an embodiment of the present invention.

Next referring to FIG. 3, FIG. 3 shows the view of patient lift 100 from the bottom perspective. From this view, first motor 311 and second motor 312 are shown. Furthermore, slider 315 and spring to extend or withdraw first extendable leg 105A and second extendable leg 105B can also be illustrated.

Figure 4:
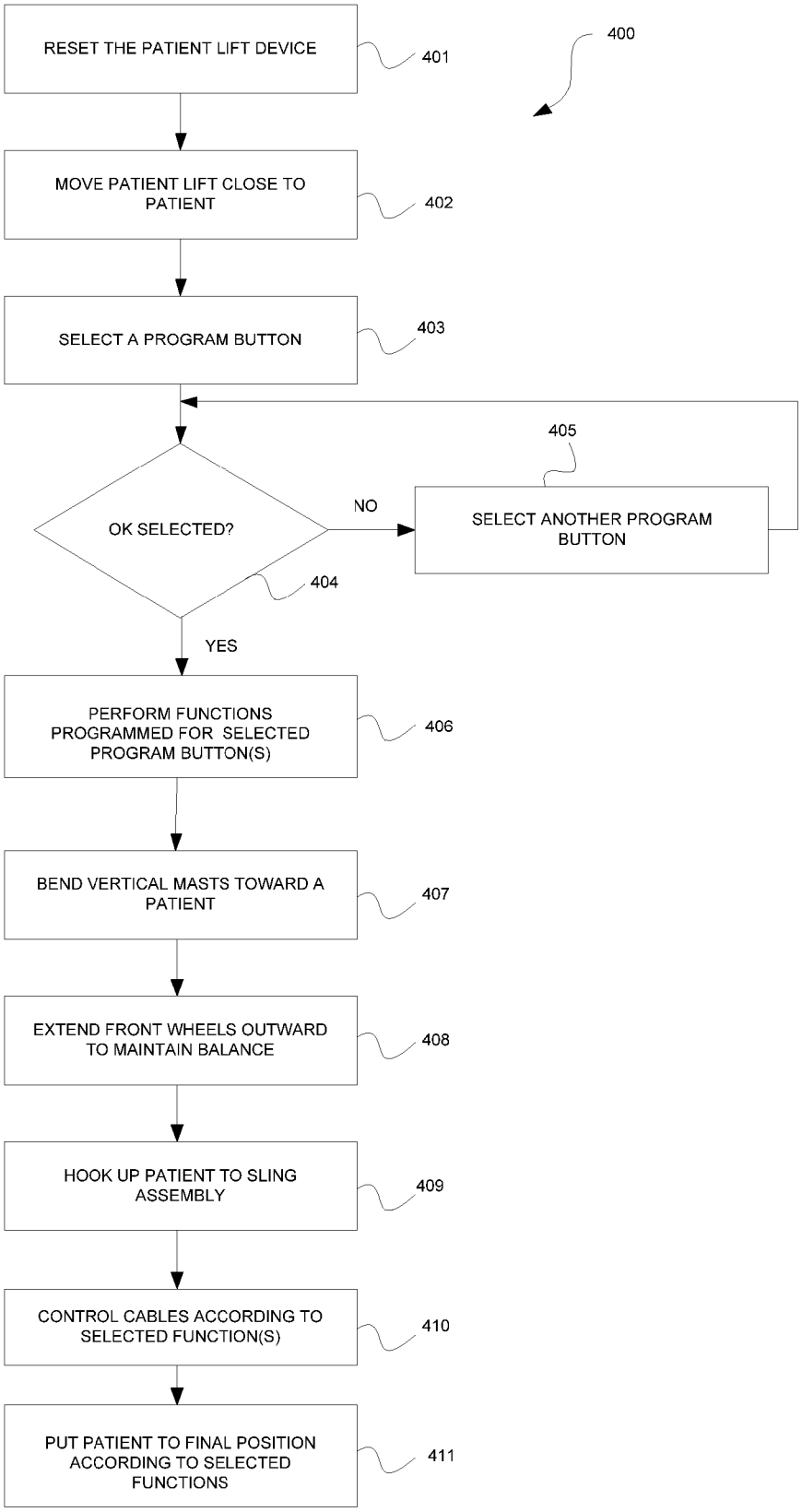
FIG. 4 is a diagram illustrating a method for lifting a patient in accordance with an embodiment of the present invention.

Now referring to FIG. 4, a method 400 for operating patient lift 100 described above is illustrated. Basically, control panel 111 has a micro-controller (not shown) programmed to control first motor 311, second motor 312, third motor 313, fourth motor 151, fifth motor 106, sixth motor 181, and seventh motor 182 in accordance with predetermined situations when lifting a patient.

At step 401, lift device 100 is reset to its initial position. That is a straight up position perpendicular to the ground. More specifically, if the x-z surface is parallel to the ground, at the reset position, patient lift 100 is coincide to the y-axis as illustrated in FIG. 1. Step 401 is performed by releasing fifth motor 106 so as it pushes first mast 131 and second mast 132 to a vertical direction perpendicular to the ground.

Then at step 402, patient lift 100 is moved to where a patient in need of transport. Step 402 is realized by using control panel 111 to move forward, backward, turn left, turn right to the patient's location.

At step 403, a user or a medical assistant selects at least one command buttons on control panel 111.

At step 404, if a completion button is entered, the command selected at step 403 is final and micro-controller or control panel 111 perform steps programmed in that command. Otherwise, micro-controller waits for another command button to be pressed. In other words, according to the present invention, a command button is only performed when it receives the completion command.

Next, at step 405, a second command is selected.

At step 406, after the completion command is received, steps pre-programmed in one or two commands are performed.

At step 407, patient lift 100 is bent down to receive a patient. This step is carried out by fifth motor 106 reduces its length, causing first mast 131 and second mast 131 to rotate forward. At the same time, foldable chair 120 is folded up. This step 407 is illustrated in FIG. 2.

Next, at step 408, first extendable leg 105A and second extendable leg 105B are pushed forward by third motor 313 so as patient lift 100 will not fall forward when lifting up a patient.

At step 409, a user or medical assistant uses first cable 141, second cable 142, and third cable 143 to connect to sling assembly 201. More particularly, first cable 141 and second cable 142 are used on the patient's shoulder. Third cable 143 is used to connect to sling assembly 201 in the area between patient's legs.

At step 410, micro-controller on control panel 111 controls first cable 141, second cable 142, and third cable 143 accordingly to each situation specified by selected commands described in step 403 to step 404. In more details, when the patient's initial position is recumbent, first cable 141, second cable 142, and third cable 143 are controlled simultaneously to lift patient so that the recumbent posture is achieved. On the other hand, when the patient needs to change from recumbent to seated, only first cable 141 and second cable 142 are pulled up so as to cause the patient to sit up.

Finally, at step 411, the patient is transferred to a final destination.

Now, referring to FIG. 5, control panel 111 or remote control 500 is described in connection with operation of patient lift 100 described in FIG. 1-FIG. 3 above.

Structurally, remote control 500 includes a first command 501 when said user switches from an automatic mode to a manual mode. As discussed above, when problem occurs with first motor 311 and second motor 312, causing patient lift 100 to be immobile, first command button 501 is pressed to allow patient lift 100 to be operated manually.

Next, a situational command area 510 groups command buttons related to different situations in which a patient is transport. Specifically, a second command button 511 is selected when a user or medical assistant intends to lift a patient from a recumbent position to a seated position on foldable chair 120 of patient lift 100. A third command button 512 is selected when the user lifts patient from foldable chair 120 of patient lift 100 to a recumbent position in a different location. A completion command button (or "OK button) 515 is selected when a command selected by the user is final and micro-controller 111 performs the selected command(s). Otherwise, micro-controller 111 waits for another command to be entered, wherein when two command buttons are entered and then completion command button 515 is pressed, micro-controller 111 performs the two selected command buttons.

Figure 5:
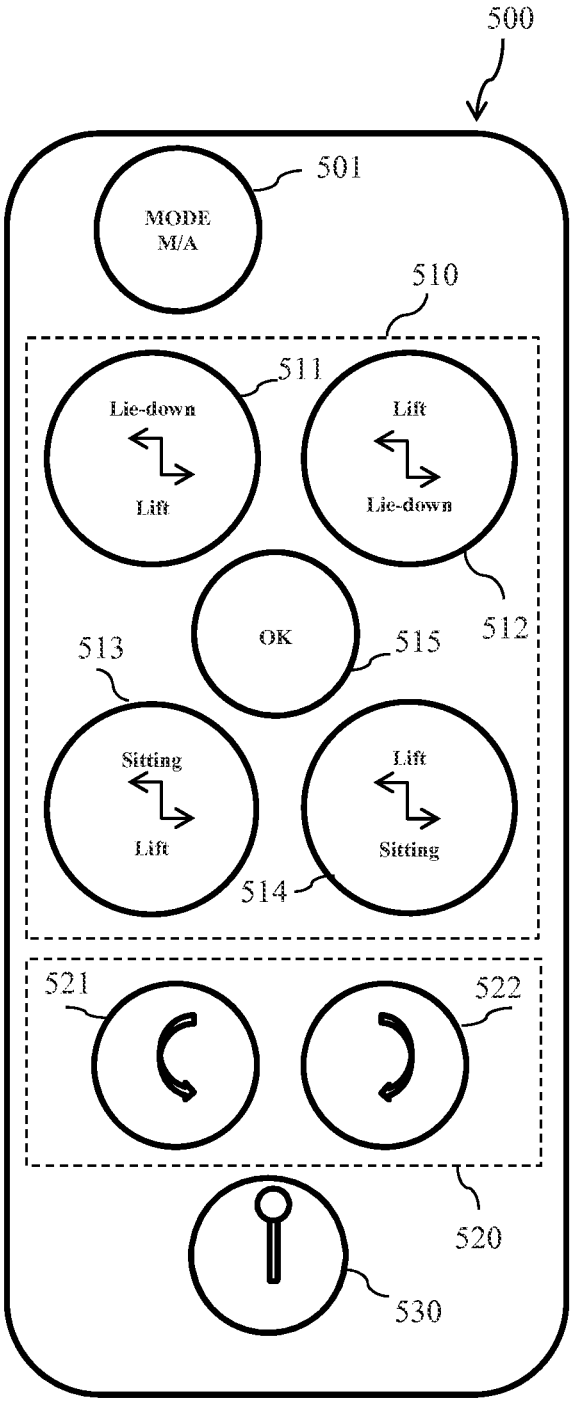
FIG. 5. is a diagram illustrating all the command buttons located on a control panel used to control the patient lift in accordance with an embodiment of the present invention.

Next, continuing with FIG. 5, a fourth command button 513 is selected when the user lifts a patient from a seated position to foldable chair 120 on patient lift 100. A fifth command button 614 is selected when the user lifts a patient from foldable chair 120 of patient lift 100 to another seated position in a different location. A sixth command button 530 is selected when the user controls the movement of patient lift 100 including increasing, decreasing the speed of patient lift 100, moving forward, turning left, turning right, and reversing of patient lift 100. In one embodiment, sixth command button 630 can be a joystick. In another embodiment, sixth command button 530 can be configured to include forward arrow, backward arrow, left arrow, and right arrow.

Continuing again with FIG. 5, a command group 520 is used when the user wants to rotate a patient by rotator 165. Command group 520 includes seventh command button 521 for is selected when the user rotates rotator 155 in a counter-clockwise direction. Finally, an eighth command button 522 is selected when the user rotates rotator 156 in a clockwise direction.

In operation, upon selecting the second command 611 and completion command button 515 are selected, micro-controller 111 causes said sixth motor 181 and seventh motor 182 to operate first cable 141, second cable 142, and third cable 143 simultaneously so that patient is assisted to sit on foldable chair 120 of patient lift 100.

Next, when second command button 511 and third command button 512 are selected and then completion command button 516 are selected, micro-processor 111 is operable to maintain the lengths of first cable 141, second cable 142, and third cable 143. Finally, micro-processor 111 transfers patient from seated position to a recumbent position in a different location.

In another occasion, when completion command button 515 is selected after fourth command 513 is selected, micro-controller 111 causes sixth motor to maintain the lengths of fit cable 141, second cable 142, and third cable 143 so that patient is transferred from a seated position to foldable chair 120 of patient lift 100.

In another situation, when fourth command button 513 and fifth command button 514 are selected, and then completion command button 516 is selected afterward, micro-controller 111 causes sixth motor 181 to cause to maintain the lengths of first cable 141, second cable 142, and third cable 143 so that patient is transferred to another seat position at a different location.

Continuing with the operation of patient lift 100 as described in FIG. 5, when second command 511 and fifth command 514 are selected together and then completion command 515 is selected, micro-controller 111 causes said sixth motor 181 and seventh motor 122 to operate first cable 141, second cable 142, and third cable 143 simultaneously. Then patient is transferred to another seated position at a different location.

Finally, when fourth command 513 and third command button 512 are selected together and completion command button 515 is selected, micro-controller 111 causes sixth motor 181 to operate first cable 141 and said second cable 142 together and seventh motor 182 to maintain third cable 143 and then to transfer patient to a recumbent position at a different location.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A patient lift, comprising:

a base having a front side and a back side;

a first wheel, a second wheel, a third wheel, and a fourth wheel mechanically connected to four corners of said base, wherein said third wheel and fourth wheel are mechanically connected to said backside of said base and electrically connected to a first motor and a second motor respectively, and wherein said first wheel and said second wheel are caster wheels mechanically connected to said front side of said base;

a first extendable leg and a second extendable leg mechanically connected to said base, wherein said first extendable leg and said second extendable leg are configured to extend or withdraw from said front side of said base;

a third motor mechanically connected to said first extendable leg and said second extendable leg in order to cause said first extendable leg and said second extendable leg extend outward or withdraw from said front side of said base through openings located on said front side of said base;

a fifth wheel mechanically connected to said first extendable leg and a sixth wheel mechanically connected to said second extendable leg, wherein said fifth wheel and said sixth wheel are caster wheels configured to swivel and change direction under a guidance of a user when moving;

a first mast and a second mast whose bottom sides mechanically connected to said back side of said base;

a lever connected to said first mast and said second mast on top sides opposite to said bottom sides;

a three-prong hanger mechanically connected to said lever;

a rotator connected to said lever and said three-prong hanger, said rotator configured to facilitate said three-prong hanger to rotate around a vertical axis;

a fourth motor coupled to said rotator operable to cause said rotator to rotate;

a first cable, a second cable, and a third cable connected to each prong of said three-prong hanger respectively, wherein said first cable and said second cable are configured to operate simultaneously and said third cable is configured to extend or withdraw independently said first cable and said second cable;

a sling assembly connected to said third cable at a location between the patient's two legs, to said first cable at the patient's left shoulder, and to said second cable at the patient's right shoulder, a foldable chair mechanically connected to said first mast and said second mast, wherein said foldable chair has a back portion and a support portion configured to support a patient, said back portion is mechanically connected to said first mast and said support portion is configured to fold up into a rest position coincided with said back portion;

a removable fifth motor mechanically connected between said first mast and said base, wherein one end of said removable fifth motor is fixedly connected to said first mast and said support portion of said foldable chair and the other end of said removable fifth motor is removably connected to said base so as said fifth motor is rested horizontally to said base when said patient lift is folded in an unused state;

a first pulley mechanically coupled to said first cable and said second cable;

a sixth motor, mechanically connected to said first pulley, operable to control said first cable and said second cable simultaneously;

a second pulley assembly mechanically coupled to said third cable;

a seventh motor, mechanically connected to said second pulley, operable to control said third cable;

a handle connected to said rear end of said base, wherein said handle comprises a control panel for controlling the operation of said first motor, said second motor, said third motor, said fourth motor, said fifth motor, said sixth motor, and said seventh motor; and a switch box electrically connected to said motor for switching between an automatic mode and manual mode.

2. The patient lift of claim 1 wherein said automatic mode of said patient lift is controlled by said control panel comprising a programmable micro-controller.

3. The patient lift of claim 2 wherein during the operation of said automatic mode, said control panel remotely controls said first motor, said second motor, said third motor, and fourth motor, said fifth motor, said sixth motor, and said seventh motor in accordance with a plurality of command buttons.

4. The patient lift of claim 3 wherein said plurality of said command buttons further comprises:

a first command button is selected when said user switches from said automatic mode to said manual mode;

a second command button is selected when said user lifts a patient from a recumbent position to a seated position on said chair of said patient lift;

a third command button is selected when said user lifts said patient from said foldable chair of said patient lift to a recumbent position in a different location;

a fourth command button is selected when said user lifts a patient from a seated position to said foldable chair on said patient lift;

a fifth command button is selected when said user lifts a patient from said foldable chair of said patient lift to another seated position in a different location;

a sixth command button is selected when said user controls the movement of said patient lift, said movement including increasing, decreasing the speed of said patient lift, moving forward, turning left, turning right, and reversing of said patient lift;

a seventh command button is selected when said user rotates said rotator in a counter-clockwise direction;

an eighth command button is selected when said user rotates said rotator in a clockwise direction; and a completion command button is selected when a command selected by said user is final and said micro-controller performs said selected command, otherwise, said micro-controller waits for another command to be entered, wherein when two command buttons are entered and then said completion command button is pressed, said micro-controller performs said two commands.

5. A patient lift according to claim 4 wherein upon selecting said second command button and said completion command button, said micro-controller causes said sixth motor and said seventh motor to operate said first, second, and third cables simultaneously and said patient is assisted to sit on said foldable chair of said patient lift.

6. The patient lift according to claim 4 wherein upon selecting said second command and said third command button and then said completion command button, said micro-processor is operable to maintain the lengths of said first cable, second cable, and third cable and then to transfer said patient from said seated position on said foldable chair to a recumbent position in a different location.

7. The patient lift according to claim 4 wherein upon selecting said completion command button is selected after said fourth command button, said micro-controller causes said sixth motor to maintain the lengths of said first cable, said second cable, and said third cable so that said patient is transferred from a sated position to said foldable chair of said patient lift.

8. The patient lift according to claim 4 wherein upon selecting said fourth command button and said fifth command button, and said completion command button, said micro-controller causes said sixth motor to maintain the lengths of said first cable, said second cable, and said third cable so that said patient is transferred from said foldable chair of said patient lift to another seated position at a different location.

9. A patient lift according to claim 4 wherein upon selecting said second command and said fifth command button are selected together and said completion command button, said microcontroller causes said sixth motor and said seventh motor to operate said first, said second cable, and said third cable simultaneously and then to transfer said patient to another seated position at a different location.

10. A patient lift according to claim 4 wherein upon selecting said fourth command and said third command button and said completion command, said micro-controller causes said sixth motor to operate said first cable and said second cable together and said seventh motor to maintain said third cable and then to transfer said patient a recumbent position at a different location.

11. The patient lift of claim 1 wherein the total length of said base including the full extension of said first and second extendable wheels is 1.6 meters and the total length of said base when said first and second extendable wheels are withdrawn is 1.2 meters, the width of said base is 0.75 meter, the height of said patient lift is 2.25 meters.

12. The patient lift of claim 1 wherein said first motor and said second motor each has a power of 106.57 watts and a speed of 200 rounds per minutes, said fifth motor has a power of 400 watts, said third motor has a power of 30 watts and speed of 300 rounds per minute, said fourth motor has a power of 30 watts and a speed of 12 round per minute.

13. The patient lift of claim 1, wherein said sixth motor and said seventh motor has a power of 186.5 watts and a speed of 21 rounds per minutes, said seventh motor has a power of 93.25 watts and a speed of 20 rounds per minutes.

* * * * *